US006568961B1

(12) United States Patent
Liburdi

(10) Patent No.: US 6,568,961 B1
(45) Date of Patent: May 27, 2003

(54) WIREFORM CONTACTOR ASSEMBLY

(75) Inventor: Steve Liburdi, Clinton Township, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/134,864

(22) Filed: Apr. 29, 2002

(51) Int. Cl.[7] ..... H01R 24/00
(52) U.S. Cl. ..... 439/630; 439/930; 439/516
(58) Field of Search ..... 439/862, 79, 82, 439/660, 860, 930, 630, 516

(56) References Cited

U.S. PATENT DOCUMENTS

| | | | | |
|---|---|---|---|---|
| 3,132,913 A | | 5/1964 | Pohl | |
| 3,340,440 A | | 9/1967 | Minter | |
| 3,885,854 A | | 5/1975 | Reimer | |
| 3,940,849 A | | 3/1976 | Minter | |
| 4,486,066 A | | 12/1984 | Minter | |
| 4,521,065 A | | 6/1985 | Nestor et al. | |
| 5,015,197 A | | 5/1991 | Redmond et al. | |
| 5,098,313 A | * | 3/1992 | Marsh et al. | 439/495 |
| 5,104,327 A | | 4/1992 | Walburn | |
| 5,564,951 A | * | 10/1996 | Attal et al. | 439/676 |
| 5,980,330 A | | 11/1999 | Veselaski et al. | |
| 6,000,969 A | * | 12/1999 | Reichardt et al. | 439/630 |
| 6,142,814 A | | 11/2000 | Wu et al. | |
| 6,244,911 B1 | * | 6/2001 | Heim | 439/862 |
| 6,379,187 B2 | * | 4/2002 | Nishimatsu | 439/607 |
| 6,398,598 B2 | * | 6/2002 | Masumoto | 439/862 |

* cited by examiner

*Primary Examiner*—Tho D. Ta
*Assistant Examiner*—Edwin A. León
(74) *Attorney, Agent, or Firm*—Bill C. Panagos

(57) ABSTRACT

A wireform contactor assembly provides a self-retained cantilever-type sliding electrical contactor that is easy to assemble, solderable, and easily separated into electrically isolated contact legs using a severable connecting portion to join a pair of generally U-shaped legs. A carrier includes a clip or other retaining members to secure the wire contactor to the carrier and allow sliding engagement of the assembly with an extender or sliding member. The wireform contactor is made of a resilient material, such as a conductively coated phosphor bronze wire, and secured in a cantilever arrangement within the carrier to facilitate electrical coupling of the contactor and conductors on the sliding member. The modular assembly may be used to provide remote switching or coupling perpendicular to a printed circuit board, for example.

17 Claims, 5 Drawing Sheets

WIREFORM CONTACTOR ASSEMBLY

FIELD OF THE INVENTION

The present invention relates to a modular wireform contactor assembly.

BACKGROUND ART

Various types of electrical connectors and/or contactors have been developed for a wide variety of applications found in the prior art.

For example, U.S. Pat. No. 4,521,065 discloses a socket connector for parallel circuit boards. The connector includes a connector body and a plurality of wireform contacts. The contacts may be positioned in the connector body and held in place by the resilience of the wireform and by a locking nib located in the connector body.

U.S. Pat. No. 5,015,197 discloses an electrical connector and cable using spring grade wire. The connector includes a connector body having side walls that hold a plurality of wires in resilient contact with the connector body. The wires include a plurality of contact points positioned to contact printed circuit boards inserted into the connector.

U.S. Pat. No. 5,980,330 discloses a snap fit contact assembly. The assembly includes a connector body and a planar metallic contact having deflectable snap tabs that secure the contact within the connector body.

U.S. Pat. No. 6,142,814 discloses a guide post of an electrical connector. The spring biased guide post is used to properly align the connector with a mating connector.

However, none of the prior art connectors or contactors disclose a modular assembly that may be used for a switching application to selectively couple circuits under dynamic conditions. In particular, the prior art contactors or connectors do not easily facilitate a perpendicular switching connection relative to a circuit board.

SUMMARY OF THE INVENTION

The present invention provides a wireform contactor assembly that includes a resilient, conductive wireform contactor and an associated carrier. The wireform contactor includes a pair of generally U-shaped members joined by a connecting portion. In one embodiment, the connecting portion is selectively severable to electrically isolate the two U-shaped members after assembly into the carrier. The connecting portion may be scored to facilitate severing the connection. The contactor may be positioned in a cantilever arrangement in the carrier and secured with a clip or other retaining means to provide selective sliding engagement with conductors associated with a sliding or extending member. A second contactor and carrier assembly may be provided at the remote end of the extending member to facilitate selective coupling of the conductors on the extending member to provide a switching function with movement perpendicular to a circuit board, for example.

The present invention includes a number of advantages. For example, the present invention may be used as an inexpensive cantilever style electrical contactor. The resilient contactor includes legs that facilitate easy assembly and self retention. In one embodiment, the shape of the contactor provides a center leg that can be used as a locator for assembly of the carrier to a printed circuit board. Stiffness of the wireform contactor allows ease of soldering the contactor to a printed circuit board. The connection portion joining the legs of the wireform contactor may be sheared or otherwise severed to electrically isolate the contactor legs if desired. The modular design of the carrier allows use as a sliding switch for switching perpendicular to a printed circuit board with the carrier fixed to the circuit board or positioned for movement along an extending element.

The above advantages and other objects, features and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
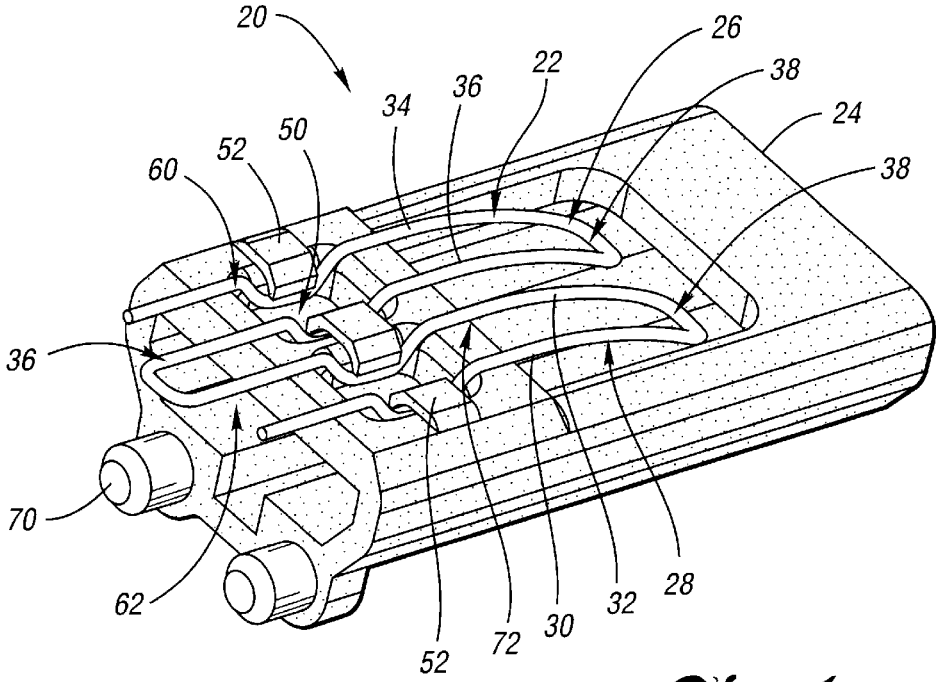
FIG. 1 is a perspective view of one embodiment of a wireform contactor assembly according to the present invention.

Referring now to FIG. 1, a perspective view of one embodiment of a wireform contactor assembly according to the present invention is shown. Wireform contactor assembly 20 preferably includes an electrically conductive wire contactor 22 held generally in position by a carrier 24. Electrically conductive wire contactor 22 includes a pair of generally U-shaped members 26, 28 each having a pair of resilient legs 34, 36 and 30, 32, respectively, extending from corresponding intermediate portions 38. A connecting section 36 joins the pair of generally U-shaped members 26, 28.

Carrier 24 is preferably made of a non-conductive material, such as plastic, for example. Carrier 24 includes at least one channel 50 formed therein. The at least one channel 50 includes one or more retention edges 52 adapted to receive at least one leg of the generally U-shaped members 26, 28. Retention edges 52 hold the electrically conductive wire contactor 22 in a generally fixed position relative to carrier 24 in cooperation with channel 50 and retaining section 60 of the wire contactor 22.

Figure 13:
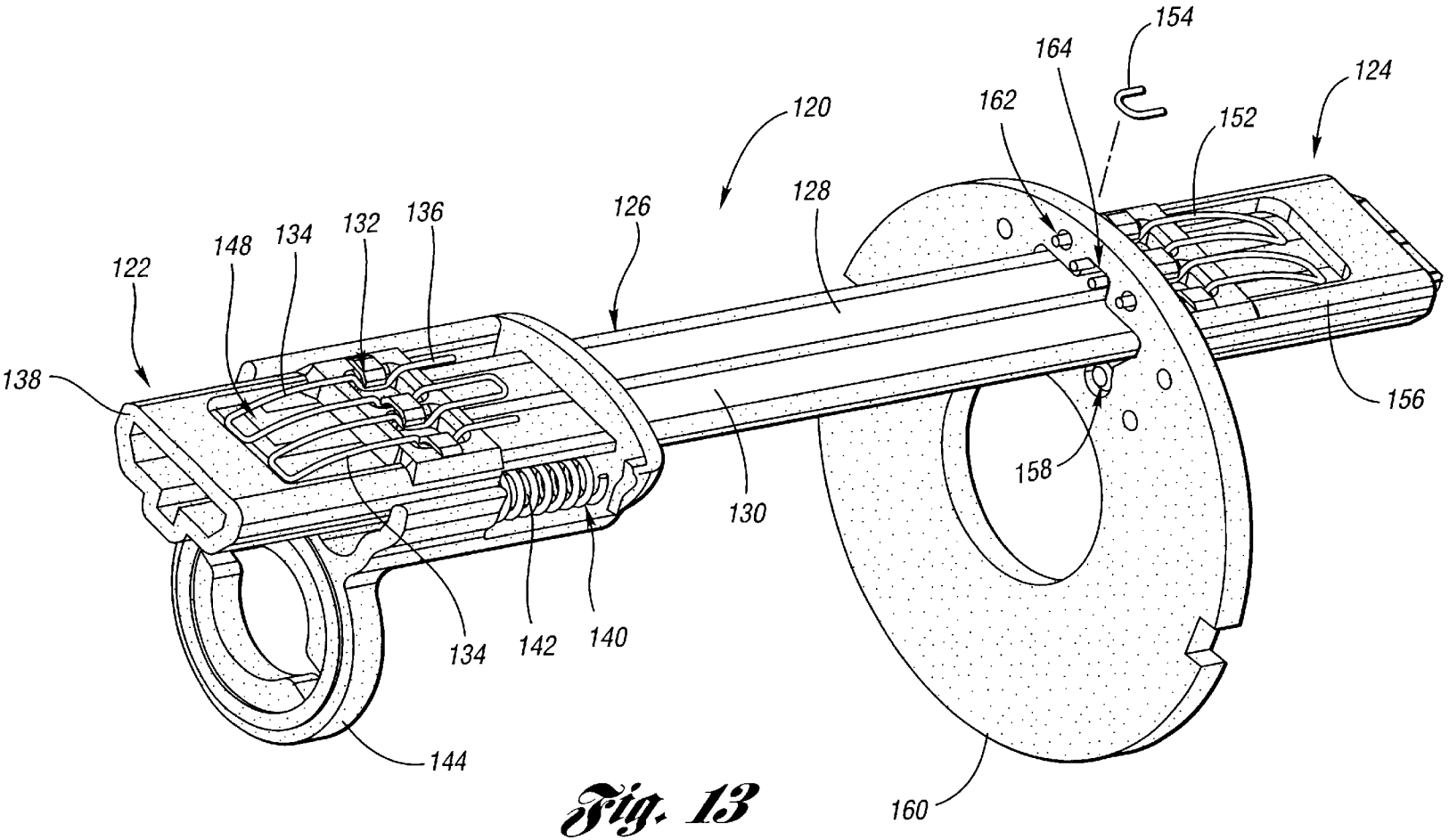
FIG. 13 is a perspective view illustrating internal details of the possible application of a wireform contactor assembly as shown in FIGS. 9–12.
Figure 14:
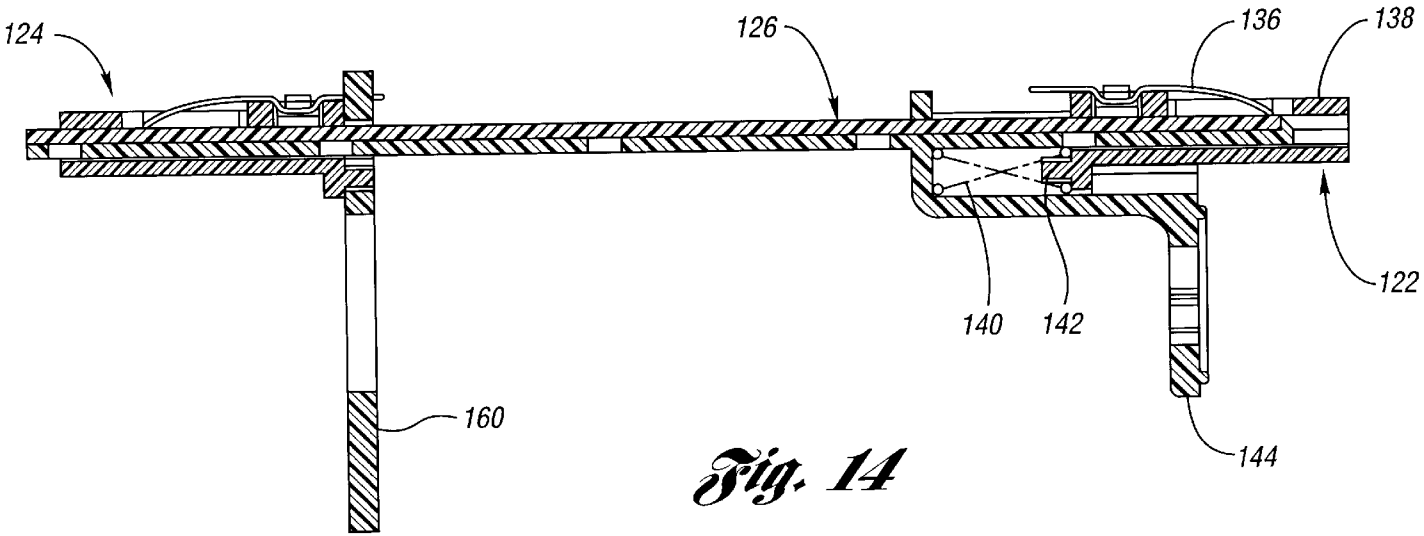
FIGS. 14–15 are cross sectional views illustrating relative positioning of the wireform contactor assemblies and circuit board for the representative application illustrated in FIG. 13.
Figure 15:
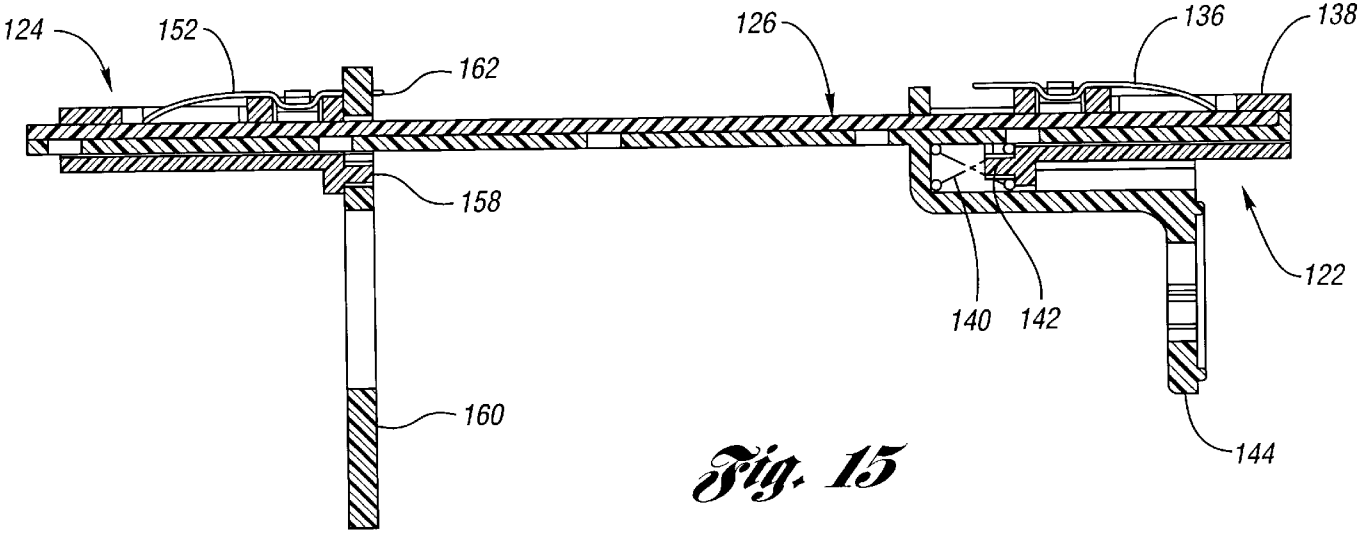

As also illustrated in FIG. 1, carrier 24 includes a cavity 62 formed therein for receiving a conductive member (FIGS. 13–15). Generally U-shaped members 26, 28 are resiliently biased so that intermediate portions 38 contact associated conductors on the conductive member while allowing relative movement between carrier 24 and the conductive member as explained in greater detail below.

Carrier 24 may include one or more locator posts which may be used to locate carrier 24 relative to a printed circuit board, for example. Alternatively, locator posts 70 may be used for locating one or more biasing springs as best illustrated and described with reference to FIGS. 13–15. In one embodiment, connecting portion or section 36 of electrically conductive wire contactor 22 is selectively severable to electrically isolate generally U-shaped members 26, 28. To facilitate separation from generally U-shaped members 26, 28, connecting portion or section 36 may be delineated by a pair of score lines (not shown) or it may have a reduced diameter, for example, depending upon the particular application. Alternatively, connecting section 36 may be severed using a manual or automatic wire cutting tool or the like.

The embodiment illustrated in FIG. 1 includes appropriate bends in electrically conductive wire contactor 22 as generally represented by area 60 which cooperate with retaining edges 52, channel 50, and associated surface 72 of carrier 24 in a cantilever arrangement to facilitate the sliding engagement of intermediate portions 38 with associated conductors (not shown). Electrically conductive wire contactor 22 is preferably made of a suitable material to provide the necessary resilience. In one embodiment, electrically conductive wire contactor 22 is made of a phosphor bronze wire having a conductive plating to provide the desired electrical conductivity and resilience. Those of ordinary skill in the art will recognize various other alternative materials and constructions to provide a suitable conductivity and resilience to facilitate assembly and repetitive sliding engagement of the wire contactor with an associated circuit board or other conductive member as described herein.

Figure 2:
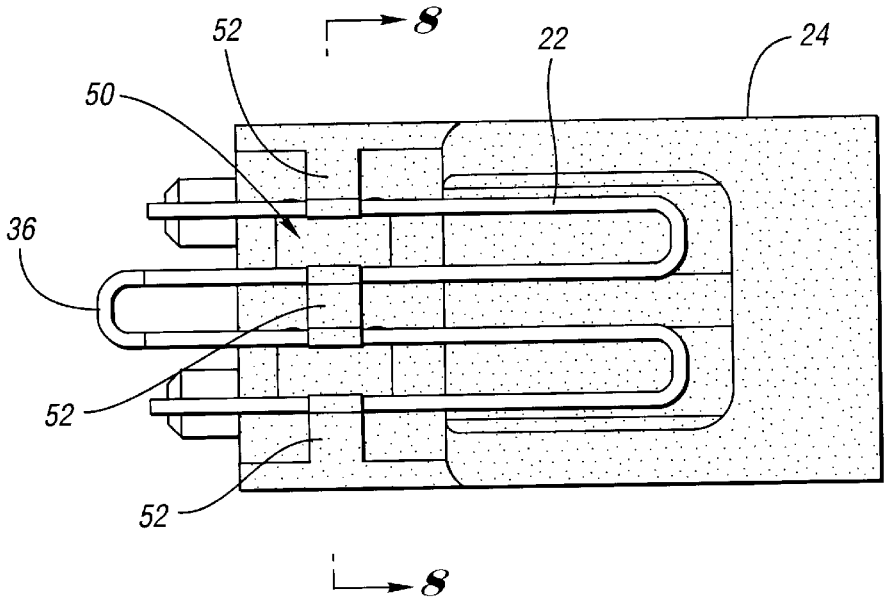
FIG. 2 is a plan view of one embodiment of a wireform contactor assembly according to the present invention.

FIG. 2 is a plan view of one embodiment of a wireform contactor assembly according to the present invention. As illustrated in FIG. 2, electrically conductive wire contactor 22 may be held in position relative to carrier 24 using one or more retaining means 52 that may be integrally formed with carrier 24. Alternatively, retaining means may be separately attached to carrier 24 and/or may include a variety of fasteners, adhesives, or the like to generally fixedly position wireform contactor 22 relative to carrier 24. In a preferred embodiment, retaining means 52 cooperates with one or more legs of wireform contactor 22 to facilitate easy assembly while maintaining translational positioning of contactor 22 within carrier 24 to allow sliding engagement of contactor 22 with corresponding conductors as described and illustrated herein.

Figure 3:
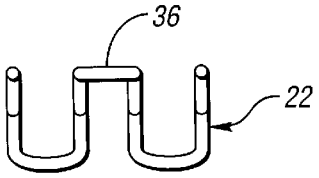
FIG. 3 is a front view of one embodiment of a wireform contactor for use in an assembly according to the present invention.
Figure 4:
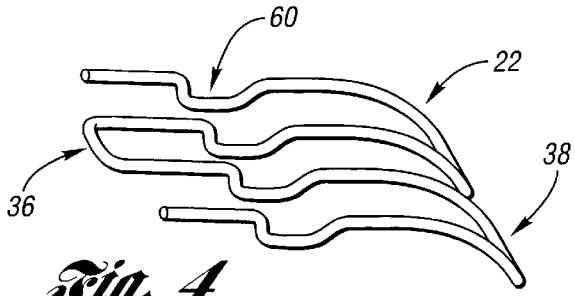
FIG. 4 is a perspective view of the wireform contactor illustrated in FIG. 3.
Figure 5:
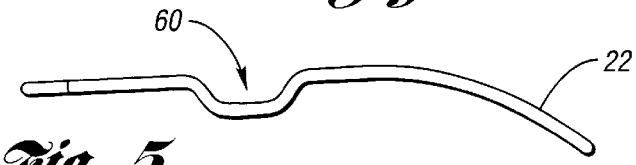
FIG. 5 is a side view of the wireform contactor illustrated in FIG. 3.

FIGS. 3–5 illustrate one embodiment of a conductive wire contactor for use in a wireform contactor assembly according to the present invention. In this embodiment, wire contactor 22 is formed from a continuous piece of wire shaped to provide at least two portions 38 arranged to facilitate sliding engagement of corresponding conductors in a cantilever arrangement relative to a carrier. Preferably intermediate portions 38 extend below retaining portion 60 as illustrated in the front view of FIG. 3 and the side view of FIG. 5. Retaining portion 60 may be used to generally position contactor 22 within a carrier and limit translational movement of the contactor within the carrier as illustrated in FIGS. 1 and 2, for example. Alternatively, retaining portion 60 may extend to approximately the same position as intermediate portions 38 to provide a secondary contact with a conductive member, depending upon the particular application. As illustrated in FIGS. 3–5, contactor 26 preferably includes at least one connecting portion 36 which may be selectively severed to electrically isolate intermediate portions 38 as described in greater detail below.

Figure 6:
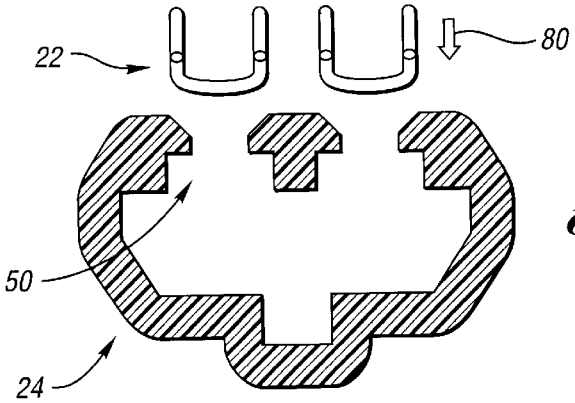
FIGS. 6–7 are partial cross-sectional views illustrating assembly of a wireform contactor assembly according to one embodiment of the present invention.
Figure 7:
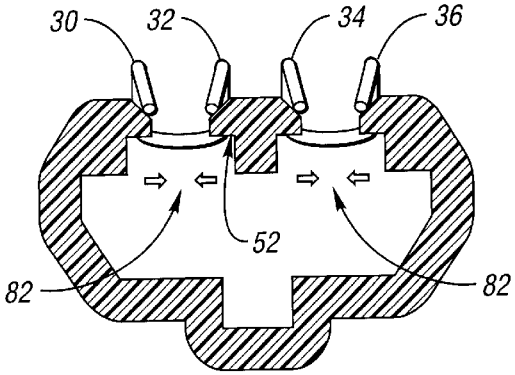
Figure 8:
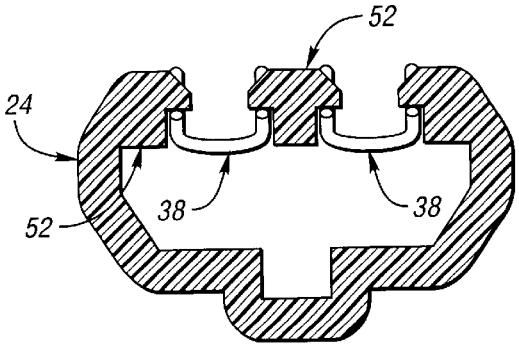
FIG. 8 is a cross-sectional view of the contactor assembly embodiment taken alone line 8—8 of FIG. 3.
Figure 9:
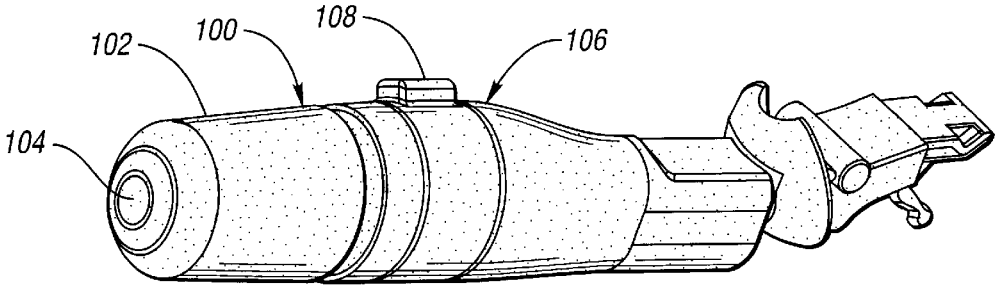
FIGS. 9–12 illustrate a possible application for a wireform contactor assembly according to one embodiment of the present invention.
Figure 10:
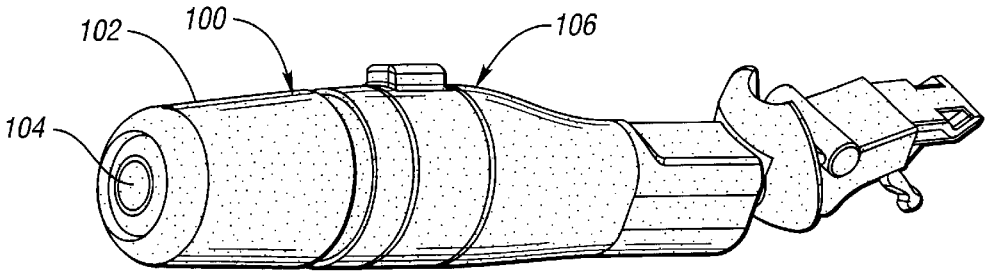
Figure 11:
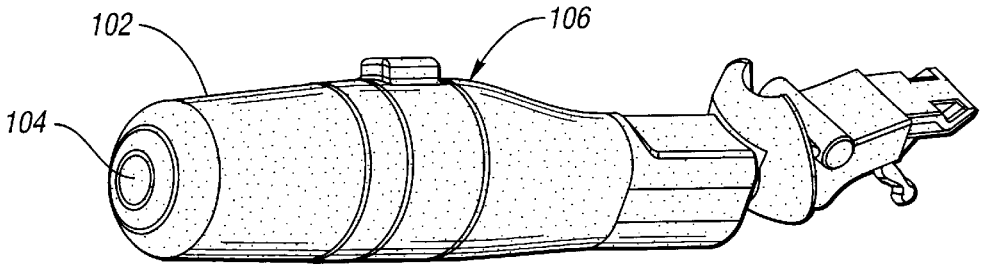
Figure 12:
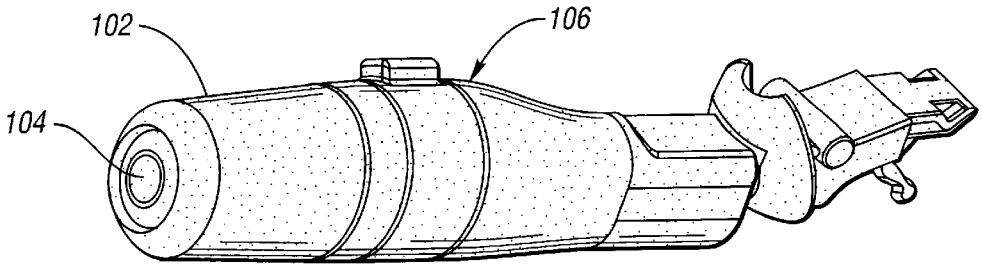

FIGS. 6–8 are partial cross-sectional views taken along line 8—8 of FIG. 2 illustrating assembly of a wireform contactor and carrier according to one embodiment of the present invention. As shown in FIG. 6, wire contactor 22 is inserted into channel 50 as represented generally by arrow 80. As shown in FIG. 7, resilient legs 30, 32, 34, and 36 of contactor 22 are displaced inwardly as represented generally by reference numeral 82 and subsequently released such that they engage retaining means 52 as illustrated in FIG. 8. The resilient nature of the contactor cooperates with retaining means 52 to hold the contactor in a generally fixed position relative to carrier 24. When assembled, intermediate portions 38 extend below retaining edges 52 to provide sliding engagement with a conductive member as described and illustrated with reference to FIGS. 13–15. The resilient nature of wire contactor 22 also facilitates a sufficient physical coupling force between intermediate portions 38 and corresponding conductive members to provide electrical coupling therebetween.

In the preferred embodiments illustrated, the contactor is form from a continuous piece of a generally cylindrical material. The use of a generlaly cylindrical wireform contactor may consume less volume of material per piece compared to other form factors, such as a flat contactor, for example. When used as a fixed contactor as illustrated in FIGS. 13–15, the wireform contactor offers rigid legs for soldering to a conductive plate or circuit board. In addition, the wireform contactor provides a connecting portion which can be easily sheared or otherwise severed to provide electrical isolation between the pairs of contactor legs.

FIGS. 9–12 illustrate a possible application for a wireform contactor assembly according to one embodiment of the present invention. In this representative application, a multi-function switch stalk 100 includes a first switch actuated by knob 102 and a second switch activated by push button 104. Knob 102 and push button 104 translate relative to each other and relative to portion 106 of switch stalk 100. In this application, push button 104 is a momentary contact switch and must travel with knob 102 such that push button 104 is operable in either position (retracted or extended) of knob 102. Various other switches may also be provided for operation of associated accessories, for example. In the embodiment illustrated, a rotational switch 108 may be provided in combination with the translational switches operated by knob 102 and push button 104.

FIG. 13 is a perspective view illustrating internal details of one possible application as shown in FIGS. 9–12. Switch assembly 120 includes a first wireform contactor assembly 122 and a second wireform contactor assembly 124 positioned for sliding engagement relative to a conductive member 126. Conductive member 126 preferably includes first and second conductors 128, 130, respectively. First wireform contactor assembly 122 includes retaining means 132 adapted to receive at least one of the legs of generally U-shaped members 134 to hold a first contactor 136 in a generally fixed position relative to carrier 138. First wireform contactor assembly 122 preferably includes at least one biasing member or spring 140 positioned on corresponding locator post 142. Spring 140 cooperates with locator post 142 and carrier 138 to bias first wireform contactor assembly 122 relative to holder 144. Preferably, two springs are used with associated locator posts to reduce rocking and provide an appropriate resistance for the momentary contact switch.

As illustrated in FIG. 13, first contactor assembly 122 acts as a switch operated by knob 102 in FIGS. 9–12. In the position illustrated in FIG. 13, contactor 136 is used to selectively electrically couple conductors 128 and 130. In the position shown, contactor 136 extends beyond a first end 148 of conductors 128 and 130 such that it does not contact or couple the conductors in this position. One or more springs 140 operates to provide a momentary contact switch such that contactor 136 slidingly engages conductors 128 and 130 when the push button is depressed and held. Springs 140 return the switch to the position shown in FIG. 13 when the push button is released.

Second contactor assembly 124 includes a corresponding electrically conductive wire contactor 152 having a pair of generally U-shaped members with resilient legs extending from an intermediate portion. Contactor 152 is illustrated after removal of a connecting portion 154 to electrically isolate the U-shaped members. Preferably, connecting portion 154 is severed or removed after carrier 156 has been positioned using locating post 158 positioned in a corresponding hole in circuit board 160. Similarly, legs 162 preferably extend through corresponding holes in circuit board 160. Connecting portion 154 may also be used for locating assembly 124 by extending through an associated notch 164 of circuit board 160 to provide additional locating points during assembly. Legs 162 also provide rigid members passing through circuit board 160 for soldering or other electrical connection to associated circuits on circuit board 160.

FIGS. 14–15 are cross-sectional views illustrating relative positioning of the wireform contactor assembly and circuit board for the representative application illustrated in FIG. 13. FIG. 14 illustrates a momentary contact switch in the "off" position while FIG. 15 illustrates the momentary contact switch in the "on" or depressed position. In operation, contactor assembly 122 functions as the momentary contact switch remotely positioned relative to circuit board 160 and selectively electrically couples conductors on sliding member 126 to provide a perpendicular switch for circuit board 160. Contactor assembly 124 operates to provide sliding engagement of conductors on sliding member 126 with fixed circuit board 160.

As illustrated in FIGS. 13–15, the wireform contactor assembly according to the present invention can be used in a moving condition to bridge circuits on a conductive plate or circuit board where it is necessary for a current to pass from one leg to the next. In addition, it can be used on a fixed primary conductive plate or circuit board to transfer current from a moving secondary conductive plate to the primary plate. In this condition, the connecting portion of the wire contactor is severed or separated to electrically isolate the corresponding circuits on the circuit board which are selectively coupled using another contactor assembly which has the connecting portion of the wire contactor left intact. As also illustrated, the wireform contactor provides rigid members which may be used to pass through a primary plate or circuit board for soldering. The connecting portion offers an extension which can be sheared or otherwise separated to electrically isolate the legs of the contactor. This provides an inexpensive and compact alternative to switching a circuit moving perpendicular to a primary conductive plate.

The non-conductive carrier, according to the present invention, also serves a dual purpose in providing easy assembly of the wireform contactor which can be accomplished by hand. The locator posts serve both as spring posts for the moving application and can be used to locate the carrier relative to the circuit board for the fixed application.

As such, the present invention provides an inexpensive cantilever style electrical contactor. The resilient contactor includes legs that facilitate easy manual or automated assembly and self-retention once assembled. In one embodiment, the shape of the contactor provides a center leg that can be used as a locator for assembly of the carrier to a printed circuit board. Stiffness of the wireform contactor allows ease of soldering the contactor to a printed circuit board. The connecting portion joining the legs of the wireform contactor may be sheared or otherwise severed to electrically isolate the contactor legs if desired. The modular design of the carrier allows use as a sliding switch for switching perpendicular to a printed circuit board with the carrier fixed to the circuit board or positioned for movement along an extending element.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A wireform contactor assembly comprising:

an electrically conductive wire contactor having a pair of generally U-shaped members, each member having a pair of resilient legs extending from an intermediate portion and a connecting section joining the pair of generally U-shaped members; and a carrier for holding the contactor, the carrier having at least one channel formed therein, the at least one channel having at least one retention edge adapted to receive at least one leg of each of the generally U-shaped members to hold the contactor in a generally fixed position relative to the carrier, the carrier having a cavity formed therein for receiving a conductive member having a pair of conductors formed thereon, wherein the generally U-shaped members are resiliently biased so that the intermediate portions contact the conductors while allowing relative movement between the carrier and the conductive member.

2. The wireform contactor assembly of claim 1 wherein the carrier further comprises at least one locator post for locating the carrier relative to a printed circuit board.

3. The wireform contactor assembly of claim 1 wherein the connecting section is selectively severable to electrically isolate the pair of generally U-shaped members.

4. The wireform contactor assembly of claim 1 wherein the connecting section includes a pair of score lines to facilitate separation from the pair of generally U-shaped members.

5. The wireform contactor assembly of claim 1 wherein the wire contactor is disposed in a cantilever arrangement relative to the carrier to facilitate sliding engagement of the intermediate portions with the conductors.

6. The wireform contactor assembly of claim 1 wherein the wire contactor comprises a phosphor bronze wire having a conductive plating.

7. The wireform contactor assembly of claim 1 wherein the legs connected to the connecting section of the wire contactor extend within a locating tab of a printed circuit board to position the contactor assembly relative to the printed circuit board during assembly.

8. The wireform contactor assembly of claim 1 wherein the carrier further comprises a pair of locator posts, the contactor assembly further comprising a spring positioned on each locator post.

9. A wireform contactor assembly comprising:

an electrically conductive wire contactor having a pair of generally U-shaped members, each member having a pair of resilient legs extending from an intermediate portion with two legs joined via a severable connecting portion;

a carrier for holding the contactor, the carrier having retaining means adapted to receive at least one of the legs of the generally U-shaped members to hold the contactor in a generally fixed position relative to the carrier, the carrier also having a cavity formed therein for receiving a conductive member having a pair of conductors formed thereon; and a conductive member having a pair of conductors formed thereon and selectively slidingly engaging the intermediate portions of the conductive wire contactor to selectively electrically couple the contactor and the conductive member while allowing relative movement therebetween.

10. The assembly of claim 9 wherein the carrier comprises a pair of locator posts for cooperating with a spring member, the spring member biasing the carrier relative to the conductive member.

11. The assembly of claim 9 wherein the carrier includes a pair of locator posts, the assembly further comprising:

a circuit board having locating holes cooperating with the locator posts of the carrier and a locating slot cooperating with the connecting portion of the pair of locator posts for positioning the carrier relative to the circuit board during assembly.

12. The assembly of claim 11 wherein the carrier is fixed to the circuit board and the severable connecting portion is severed to electrically isolate the pair of generally U-shaped members of the contactor.

13. The assembly of claim 9 wherein the conductive member includes first and second end portions with the conductors extending between the first and second end portions, the first end portion selectively slidingly engaging the contactor, the assembly further comprising:

a second electrically conductive wire contactor having a pair of generally U-shaped members, each member having a pair of resilient legs extending from an intermediate portion with two legs joined via a connecting portion;

a second carrier for holding the second contactor, the second carrier having retaining means adapted to receive at least one of the legs of the generally U-shaped members of the second contactor to hold the second contactor in a generally fixed position relative to the second carrier, the second carrier also having a cavity formed therein for receiving the second end portion of the conductive member wherein the intermediate portions of the second conductive wire contactor selectively electrically couple the conductors of the conductive member while allowing relative movement between the second contactor and the conductive member.

14. The assembly of claim 13 wherein the connecting section of the contactor is severed to electrically isolate the generally U-shaped members of the first contactor.

15. An assembly comprising:

a first electrically conductive wireform contactor having a pair of generally U-shaped members, each member having a pair of resilient legs extending from an intermediate portion with two legs joined via a severable connecting portion;

a first carrier for holding the first contactor, the first carrier having retaining means adapted to receive at least one of the legs of the generally U-shaped members to hold the first contactor in a generally fixed position relative to the first carrier, the first carrier also having a cavity formed therein for slidingly receiving a sliding member having a pair of conductors formed thereon and extending form a first end portion to a second end portion, the first carrier including a pair of locator posts for positioning the first carrier during assembly;

a circuit board having locating holes cooperating with the locator posts of the first carrier and a locating slot cooperating with the connecting portion of the first contactor, the circuit board being fixed relative to the first carrier with the connecting portion of the first contactor being severed to electrically isolate the pair of generally U-shaped members after the first carrier is fixed to the circuit board;

a second electrically conductive wire contactor having a pair of generally U-shaped members, each member having a pair of resilient legs extending from an intermediate portion with two legs joined via a connecting portion;

a second carrier for holding the second contactor, the second carrier having retaining means adapted to hold the second contactor in a generally fixed position relative to the second carrier, the second carrier also having a cavity formed therein for receiving the second end portion of the sliding member wherein the intermediate portions of the second conductive wire contactor selectively electrically couple the conductors of the sliding member while allowing relative movement between the second contactor and the sliding member, the second carrier also including a pair of locator posts for cooperating with corresponding springs for biasing the second carrier relative to the sliding member.

16. The assembly of claim 15 wherein the first and second wire contactors are disposed in a cantilever arrangement relative to the first and second carriers, respectively, to facilitate sliding engagement of the first and second intermediate portions with corresponding conductors of the sliding member.

17. The assembly of claim 16 wherein the first and second wire contactors comprise phosphor bronze wire having a conductive coating.

* * * * *